United States Patent [19]

Hofer et al.

[11] 4,251,807

[45] Feb. 17, 1981

[54] MINIATURE BUZZER

[75] Inventors: Alan Hofer, Wantaugh; Frank Yama, North Massapequa, both of N.Y.

[73] Assignee: Pickering & Company, Plainview, N.Y.

[21] Appl. No.: 18,849

[22] Filed: Mar. 8, 1979

[51] Int. Cl.[3] ..... G08B 3/10

[52] U.S. Cl. ..... 340/384 R; 340/388

[58] Field of Search ..... 340/384 R, 384 E, 388

[56] References Cited

U.S. PATENT DOCUMENTS

| | | | |
|---|---|---|---|
| 3,846,792 | 11/1974 | Haigh | 340/388 |
| 4,159,472 | 6/1979 | Murakami | 340/388 |
| 4,183,017 | 1/1980 | Sims | 340/388 |

*Primary Examiner*—Harold I. Pitts

*Attorney, Agent, or Firm*—Kane, Dalsimer, Kane, Sullivan and Kurucz

[57] ABSTRACT

A miniature buzzer for a pocket pager and the like is provided. The buzzer includes a support member in the form of a cylindrical collar having a bore extending therethrough. The bore is stepped with the step defining a knife edge. A pole piece surrounded by a coil and ring magnet extends toward the step. The ring magnet and a central portion of the pole piece define a plane spaced apart from the step. A diaphragm, backed by a magnetic armature seats on the knife edge for attraction/repulsion toward/from the pole piece. The coil is driven by an oscillator extends from the collar. The assembly is contained within a housing the volume of which is also tuned to the oscillator.

3 Claims, 4 Drawing Figures

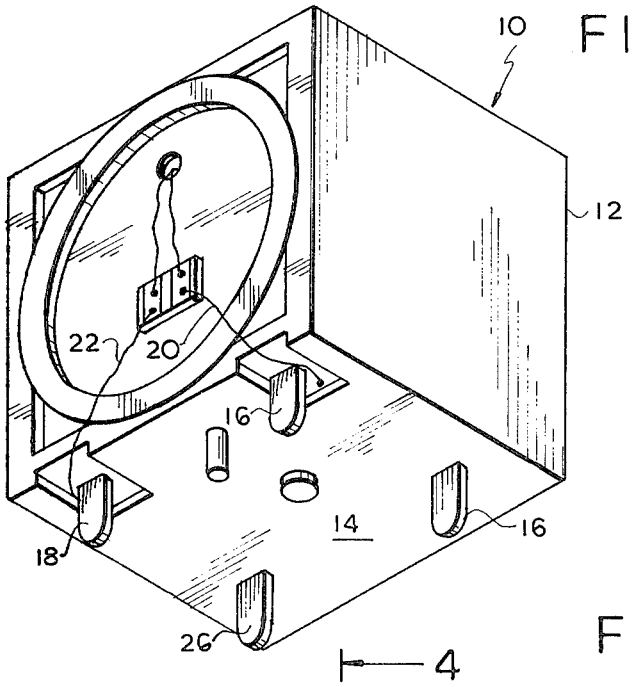
FIG. 1
FIG. 3
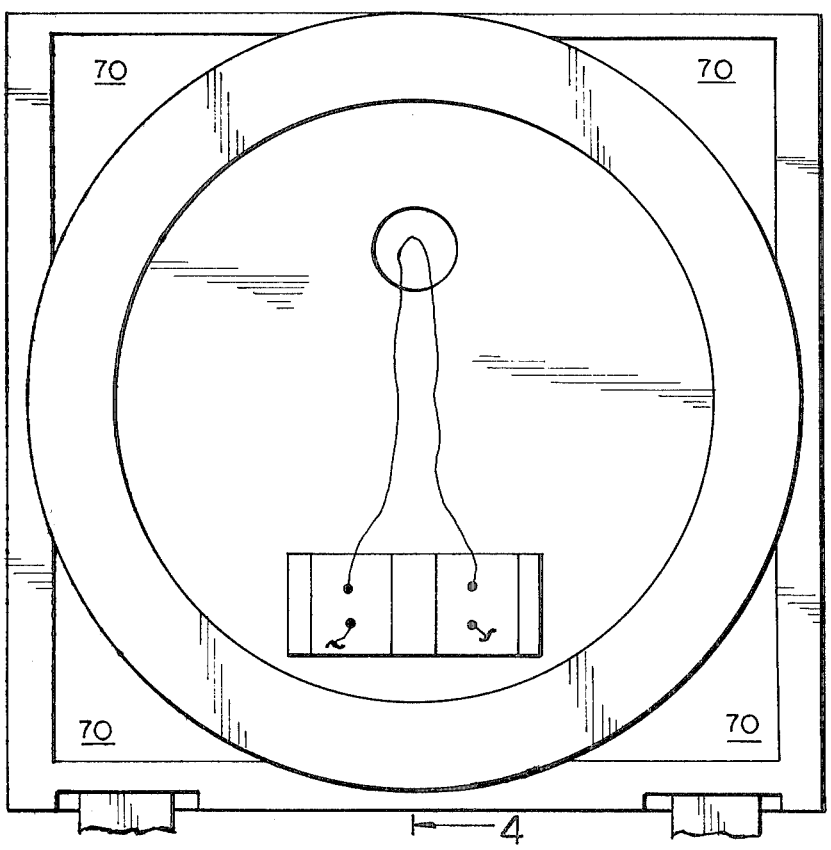

MINIATURE BUZZER

BACKGROUND OF THE INVENTION

The present invention relates to miniaturized sounders and in particular to a buzzer for a pocket paging device or the like.

Pocket pagers have gained wide use and acceptance in recent years. Such pages are commonly used by physicians, repair technicians, and others who must remain in contact with a central location. The pager, which correspondes in size roughly to that of a cigarette package, is carried in a pocket or clipped to the clothing of the user. In one common type of paging system, a radio signal at a particular frequency is generated when contact with the user is required. The radio signal serves to trigger an oscilator within the pager which, in turn, drives a buzzer. The user, upon hearing the buzzer, places a telephone call to the central location to receive his message.

Pocket pagers must be small enough to be comfortably carried by the user. In addition, the pager must be large enough to contain the buzzer along with its associated electronics and power supply. It is thus desirable to miniaturize the components of the pager as much as possible. This poses a particular problem with regard to the buzzer since the buzzer must be capable of generating a sound sufficiently loud to insure attracting the users attention regardless of ambiant noise conditions.

In view of the above, it is the principal object of the present invention to provide an improved buzzer which is small in volume but capable of producing a relatively loud, audible sound, A further object is to provide such a buzzer which is compatible with conventional pocket pager drive circuits and power sources.

A still further object is to provide such a buzzer which is reliable, efficient and which may be constructed of a small number of components which may be readily assembled.

SUMMARY OF THE INVENTION

The above and other beneficial objects and advantages are obtained in accordance with the present invention by providing an improved buzzer comprising a support member in the form of a cylindrical collar having a passage extending therethrough from end to end. A ledge or step is defined within the collar passage by having the diameter of the passage bore extending from one end smaller than the bore extending from the opposite end. The ledge is tappered to define a knife edge directed toward the passage opposite end.

A pole piece formed of a magnetic material is positioned within the passage. The pole piece has a capped end which closes the passage one end and an elongated central portion which extends from the cap toward the ledge but terminates at an end disposed short of the ledge. A coil surrounds the pole piece central portion and has leads extending outside the collar for connection to the pager drive circuit. A ring magnet is positioned within the collar passage surrounding the coil. The ring magnet terminates in a free end ground flat with and thus coplanar with the end of the elongated central portion of the pole piece.

A diaphragm is disposed within the passage seated on the ledge knife edge. An armature of a magnetic material is affixed to the diaphragm opposite to the pole piece. The armature is aligned with the pole piece and spans beyond the inner diameter of the ring magnet but short of the magnet's outer diameter.

A sounding tube in the shape of a horn is affixed to the support member extending from the opposite end of the passage. The horn has an elongated tube the length of which is tuned to the fundamental frequency or a harmonic of the paper oscilator. The buzzer assembly is positioned within a housing, the cavity of which is also tuned to the oscilator fundamental frequency or a harmonic.

BRIEF DESCRIPTION OF THE DRAWINGS

In the accompanying drawings: FIG. 1 is a perspective view taken from the rear of a miniature buzzer in accordance with the present invention;

FIG. 3 is a plan view of the rear surface of the buzzer of FIG. 1; and,

DETAILED DESCRIPTION OF THE PREFERRED EMBODIMENT

Figure 2:
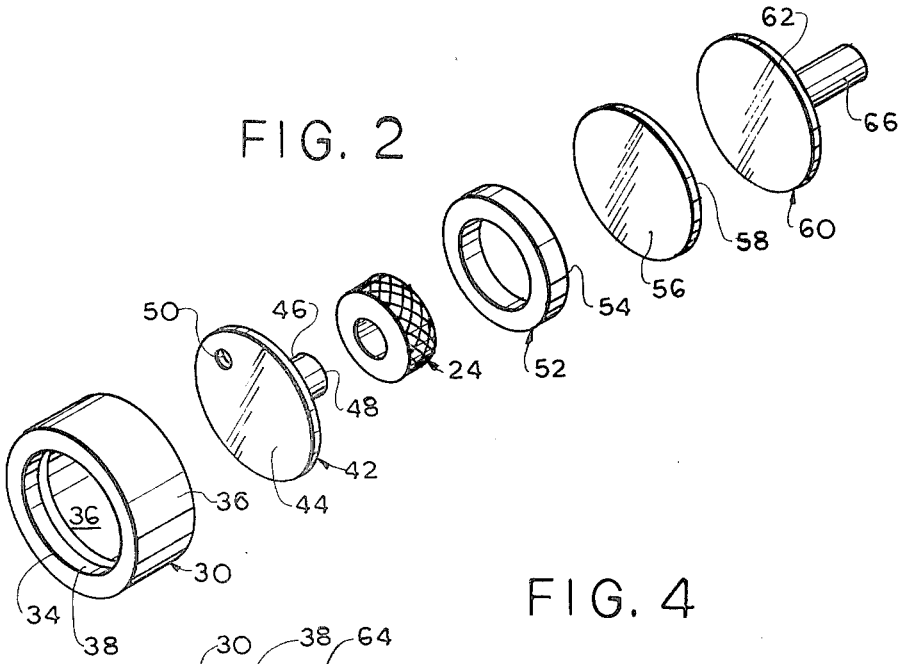
FIG. 2 is an exploded view of the buzzer drive elements.

Reference is now made to the drawings and to FIG. 1 in particular wherein a miniature buzzer 10 in accordance with the present invention is depicted. The buzzer components are contained within a housing 12 which is in the form of a cube each side of which is approximately $\frac{5}{8}$". The housing has a series of tabs extending from one face 14. Tabs 16 and 18 are connected to the ends 20 and 22 respectively of a coil 24 in a manner which will be described forthwith. These tabs, along the tabs 26, seat in sockets of a pocket pager assembly and serve to secure the buzzer in position within the pager.

Tab 16 and 18 also serve to make appropriate electrical contact with an oscilator 28 of the pocket pager drive circuit. Such pagers are well known and are well defined in the art and form no part of the present invention. It should be noted, however, that the most commonly used frequency for such oscilators is 2100 Hz.

Referring now to FIGS. 2 and 3, it can be noted that the buzzer 10 comprises a support member 30 which may conveniently be molded of a plastic material. The support member 30 is in the form of a cylindrical collar through which a passage 32 extends from one end 34 to the opposite end 36. The diameter of the bore of the passage at end 34 is less than that at end 36 thereby defining a ledge or step 38 at the interface of the two bores. The ledge is tappered toward end 36 so as to form a knife edge 40 (seen best in FIG. 4). The knife edge 40 is directed toward collar end 36.

A pole piece 42 formed of a magnetic material is positioned within the collar proximate to end 34. The pole piece comprises a cap section 44 and an integral elongated central portion 46. The elongated portion 46 extends within the collar passage 32 toward ledge 38 but terminates short of the ledge. That is, the free end 48 of pole piece portion 46 is spaced from the plane defined by the knife edge 40 extending about step 38. The cap portion 44 of pole piece 42 is captured within the collar and held in position by an appropriate slot within collar 30.

A coil 24 is disposed about the pole piece central portion. The ends 20 and 22 of the coil are brought through an opening so in pole piece cap 44 to connect with tabs 16 and 18 for eventual connection with the drive circuit oscilator 28.

A ring magnet 52 surrounds the coil. Ring magnet 52 is formed of Alnico II. Alnico II is a preferred material for ring magnet 52 since its magnetization can be closely controlled. The lower edge 54 of magnet 52 is ground flat along with the lower edge of pole piece 48 so as to define a plane. That is, when assembled in the collar the lower edge of the magnet and the free end 48 of the pole piece central portion 46 are coplaner. Thus, the lower edge of the magnet is also spaced apart from the knife edge 40. The gap between the pole piece—magnet and knife edge is seen best in FIG. 2.

Figure 4:
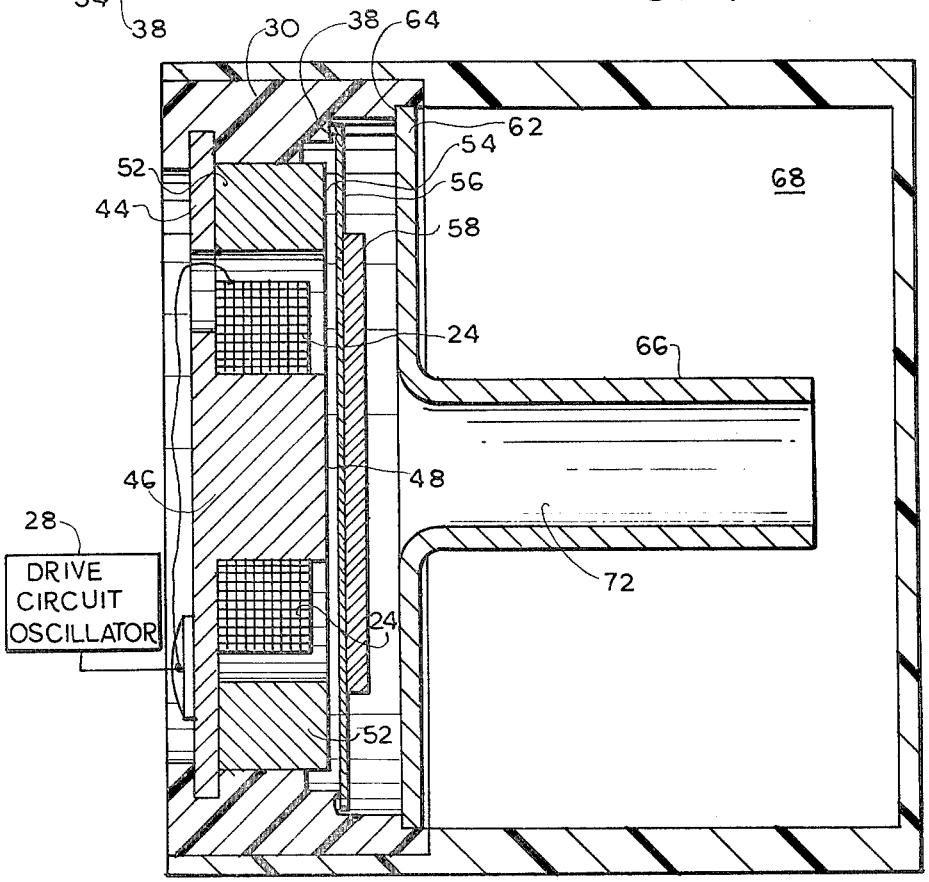
FIG. 4 is a sectional view taken along reference lines 4—4 of FIG. 3 in the direction indicated by the arrows.

A diaphragh 56 formed of a tempered magnetic material is positioned within the collar from end 36. The diaphragm rests on knife edge 40 as shown in FIG. 4. An armature 58 also formed of a magnetic material is spot welded to the rear of the diaphragm (i.e. to the side opposite the pole piece). The diameter of armature 58 is less than the diaphragm but large enough so that it spans the inner diameter of ring magnet 52 but not the outer diameter of the ring magnet.

A sound tube or horn 60 seats in a step 64 cut into the end 36 of collar 30. The horn has a flared end 62, the rim of which fits on step 64. An elongated tube 66 extends away from the flared end of the horn. The length of tube 66 is chosen to be tuned to the fundamental frequency or a harmonic of the drive circuit oscilator 28. The opening 72 through the tube and flared end 62 align with the center of pole piece as previously mentioned, the buzzer assembly is contained within a housing 12 the internal cavity 68 of which has a volume also tuned to the oscilator fundamental or a harmonic frequency. For a buzzer tuned to 2000 Hz, the dimensions of the cube should be approximately $\frac{5}{8}''$ per side. For a frequency of 1000 Hz, the volume of the cube would have to be approximately four times as great and so on. In this regard, the spaces 70 between the circular collar and square faces of the housing is left open to provide sound outlet openings.

In operation, when coil 24 is excited by a current from the output of drive circuit 28 it serves to aid and repel the magnetic attraction on the diaphragm-armature combination that is exerted by ring magnet 54. That is, at its positive peak, the coil magnetizes the pole piece so as to neutralize the magnetic attraction on the diaphragm. When the coil is driven to its negative peak, the pole piece aids the ring magnet. As a result, the diaphragm vibrates back and forth half the distance between the knife edge and the pole pieces. The spring force of the diaphragm is chosen so that its useable bow is approximately 60% of the air gap defined between the rest position of the armature (i.e. the plane of the knife edge) and the plane of the pole piece end-ring magnet. Thus in accordance with the above, the aforementioned objects are effectively attained.

Having thus described the invention what is claimed is:

1. A buzzer assembly comprising: a support member, a passage extending through said support member; a first end of said passage; an opposite end of said passage; a knife edge ledge defined within said passage between said ends directed toward said passage; a pole piece of magnetic material positioned within said passage; an elongated portion of said pole piece extending toward said passage opposite end, said elongated portion terminating in a free end spaced apart short of said ledge; a coil within said passage disposed about said elongated portion, said coil having leads extending outside said support member; a magnetic member within said passage disposed about said coil; a diaphragm seated on said knife edge closing said passage; an armature of magnetic material aligned with said elongated portion free end and affixed to said diaphragm opposite to said elongated portion free end; a drive circuit oscillator connected to said coil leads; and a sounding horn, said horn having a flared base portion affixed to said support member, an opening in said base disposed about said passage opposite end, and a tube extending away from said passage opposite end, said tube having a length tuned to the fundamental frequency or a harmonic of said oscillator.

2. The buzzer in accordance with claim 1 wherein said magnetic member comprises a ring magnet having a central opening and said armature spans across said central opening.

3. The buzzer in accordance with claim 1 further comprising a housing, an open end of said housing, said support member extending into said housing from said open end, said housing having a cavity the volume of which is tuned to the fundamental frequency or a harmonic of said oscilator and sound outlet openings extending through said housing.

* * * * *